US005251544A

United States Patent [19]

Abrams

[11] Patent Number: 5,251,544

[45] Date of Patent: Oct. 12, 1993

[54] CHUTE MOUNTING AND BIASING MECHANISM FOR STRAPPING MACHINE

[75] Inventor: Jack S. Abrams, Arlington Heights, Ill.

[73] Assignee: Signode Corporation, Glenview, Ill.

[21] Appl. No.: 25,155

[22] Filed: Mar. 2, 1993

[51] Int. Cl.[5] ..... B65B 13/06

[52] U.S. Cl. ..... 100/26; 53/589

[58] Field of Search ..... 100/25, 26; 53/589

[56] References Cited

U.S. PATENT DOCUMENTS

| | | | |
|---|---|---|---|
| 3,118,368 | 1/1964 | Lems | 100/26 |
| 4,011,808 | 3/1977 | Aoki et al. | 100/26 |
| 4,120,239 | 10/1978 | Pasic et al. | 100/26 |
| 4,244,773 | 1/1981 | Siebeck et al. | 100/26 X |
| 4,520,720 | 6/1985 | Urban et al. | 100/26 |
| 4,781,110 | 11/1988 | Sakaki et al. | 100/26 |
| 5,078,057 | 1/1992 | Pearson | 100/25 |

FOREIGN PATENT DOCUMENTS

| | | | |
|---|---|---|---|
| 1211102 | 2/1966 | Fed. Rep. of Germany | 53/589 |
| 3346598 | 10/1984 | Fed. Rep. of Germany | 100/26 |
| 2-57515 | 2/1990 | Japan | 100/26 |
| 2-233314 | 9/1990 | Japan | 100/26 |

*Primary Examiner*—Stephen F. Gerrity
*Attorney, Agent, or Firm*—Thomas W. Buckman; Donald J. Breh

[57] ABSTRACT

For a strapping machine, a mechanism is disclosed for mounting a movable chute to a fixed wall and for biasing the chute toward the wall while permitting the chute to move away from the wall so as to allow a strap to be pulled from the chute. The mechanism comprises a wall-mounted bracket, a chute-mounted bracket, and a pivot arm having an end portion connected pivotally to the wall-mounted bracket, an end portion connected pivotally to the chute-mounted bracket, and an intermediate portion, to which a coiled spring is connected at one end so as to bias the chute toward the wall but so as to permit the chute to move away from the wall. The coiled spring is connected at its other end to the first bracket and extends between the brackets.

4 Claims, 1 Drawing Sheet

Fig. 1
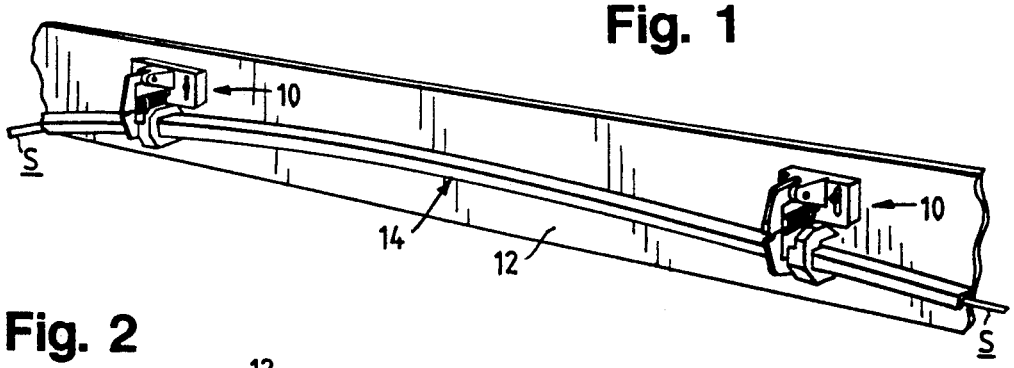
Fig. 2
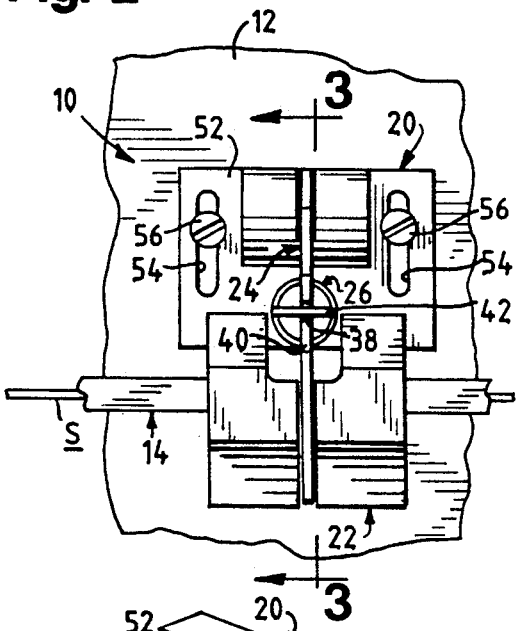
Fig. 3
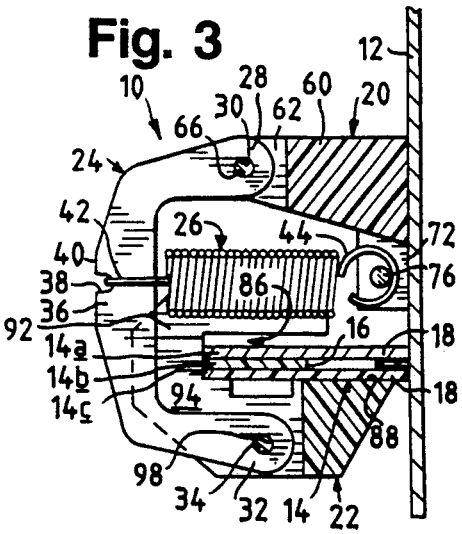
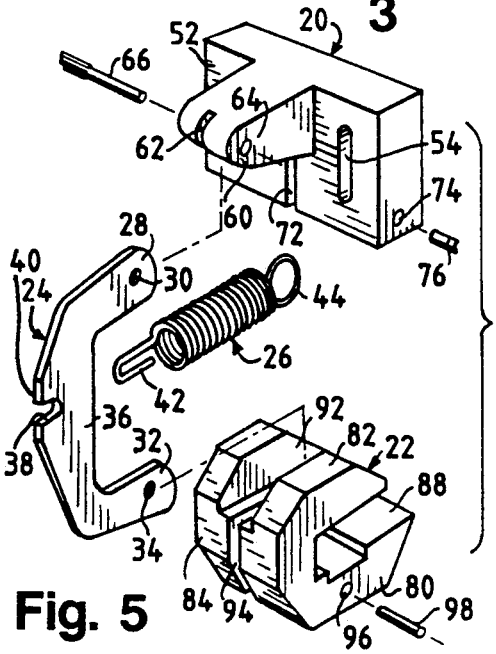
Fig. 5
Fig. 4
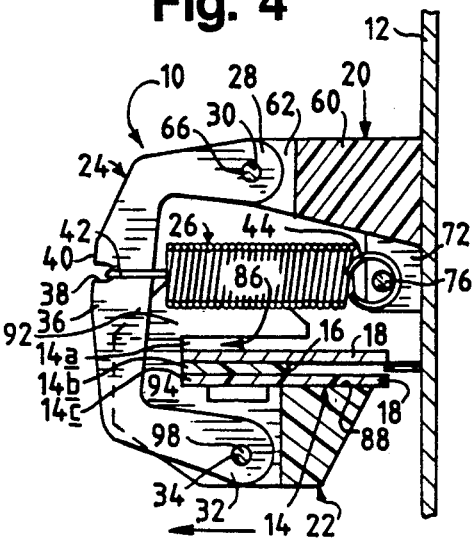

CHUTE MOUNTING AND BIASING MECHANISM FOR STRAPPING MACHINE

TECHNICAL FIELD OF THE INVENTION

This invention pertains generally to a chute system for a strapping machine of a type used to apply a polymeric or metal strap around a load. This invention pertains particularly to a mechanism for mounting a movable chute to a fixed wall, in the chute system, and for biasing the chute toward the wall while permitting the chute to move away from the wall so as to allow a strap to be pulled from the chute. The mechanism, which employs a pivotal action, provides essentially frictionless motion and is not prone to binding due to accumulation of dust or other debris.

BACKGROUND OF THE INVENTION

In a strapping machine of the type noted above, it is common to employ a chute system including a fixed wall and a movable chute, each in an arched configuration. The arched configurations enable the wall and the chute to surround a load being strapped, except where a strapping head is disposed below the load.

Typically, the chute has a generally U-shaped cross-section defining a bight and two generally parallel flanges with a space between the flanges to accommodate a strap being fed along the chute. The chute is movable toward and away from a closed position wherein the flanges bear against the fixed wall. The chute is biased toward the closed position.

Means may be provided, such as solenoid-actuated means, for moving a portion of the chute away from the fixed wall when it is desired to pull a strap from the space between the flanges. Commonly, the portion of the chute that is moved is near the strapping head, below the load. It is known, however, to employ a chute system comprising such a wall and such a chute without such means for moving a portion of the chute.

In a commonly used arrangement, the chute is mounted to the wall by a series of similar clips spaced along the chute, each clip being mounted movably on a post projecting from the wall and each clip being biased by a coiled spring toward the wall. Moreover, the coiled spring is disposed around the post, within a bore of such clip. Such an arrangement is used in Models SP-300/330 Automatic and Semi-Automatic Strapping Machines available commercially from Signode Packaging Systems (a unit of Illinois Tool Works Inc.) of Glenview, Ill., and is illustrated on pages 6–39, 6–40, of Section 6 (dated June 1992) of the Operation, Parts and Safety Manual for those Models.

Although such an arrangement has been regarded as generally satisfactory, it has been noted to have some shortcomings. Dust or other debris tends to accumulate in the bores, within which the coiled springs are disposed around the posts, whereby binding can result. Friction encountered within the bores as the chute moves toward and away from the wall also can contribute to binding. It can be difficult to replace the coiled springs or to install a new clip.

Alternative arrangements are exemplified in prior patents including Urban et al. U.S. Pat. No. 4,520,720 and Aoki et al. U.S. Pat. No. 4,011,808.

SUMMARY OF THE INVENTION

This invention provides, in a chute system for a strapping machine of the type noted above, an improved mechanism for mounting a movable chute to a fixed wall and for biasing the chute toward the wall while permitting the chute to move away from the wall so as to allow a strap to be pulled from the chute. Broadly, the improved mechanism comprises four principal components, namely two brackets, a pivot arm, and a biasing means.

In the improved mechanism, a first bracket is mounted fixedly to the wall, and a second bracket is movable conjointly with the chute. The pivot arm has a first end portion connected pivotally to the first bracket, a second end portion connected pivotally to the second bracket, and an intermediate portion. The biasing means is arranged for biasing the pivot arm so as to bias the chute toward the wall but so as to permit the chute to move away from the wall.

Preferably, the biasing means comprises a coiled spring, which is connected to the pivot arm. The coiled spring may have an end connected to the intermediate portion of the pivot arm and an end connected to the first bracket. The coiled spring may extend from the end connected to the intermediate portion of the pivot pin, between the first and second brackets, to the end connected to the first bracket.

The improved mechanism, as described above, operates with very low friction, exhibits nearly linear motion of the chute toward and away from the wall, and is not prone to binding due to accumulation of dust or other debris.

These and other objects, features, and advantages of this invention are evident from the following description of a preferred embodiment of this invention with reference to the accompanying drawings.

BRIEF DESCRIPTION OF THE DRAWINGS

FIG. 1 is a fragmentary, perspective view of a chute system for a strapping machine of a type used to apply a polymeric strap around a load. As shown, the chute system comprises a fixed wall, a movable chute, and a plurality of similar mechanisms embodying this invention, two such mechanisms being shown.

FIG. 2, on an enlarged scale, is an elevational view of a representative one of the mechanisms. The fixed wall, the movable chute, and a polymeric strap are shown fragmentarily.

FIG. 3 is a sectional view taken along line 3—3 of FIG. 2, in a direction indicated by arrows, to show the chute in a closed position.

FIG. 4 is a similar, sectional view, which shows the chute in an opened position.

FIG. 5 is an exploded, perspective view of the mechanism shown in FIGS. 2, 3, and 4.

DETAILED DESCRIPTION OF PREFERRED EMBODIMENT

As shown in the drawings, a chute system comprising a plurality of similar mechanisms 10, each 10 constituting a preferred embodiment of this invention, is employed in a strapping machine of the type noted above. Except for the chute system, the strapping machine is not shown.

Broadly, along with the mechanisms 10, the chute system comprises a fixed, steel wall 12 and a movable chute 14. The wall 12 and the chute 14 have arched configurations, which enable the chute system to extend around the top, two opposite sides, and the bottom of a load (not shown) being strapped, except where a strapping head (not shown) of the strapping machine is located beneath the load.

As shown, the chute 14 is laminated from a layer 14*a* of anodized aluminum, a middle layer 14*b* of a suitable, polymeric material, such as ultra high density polyethylene, and a layer 14*c* of a similar, polymeric material. Alternatively, the chute 14 may be entirely made from a suitable, polymeric material, as a laminate of three layers or as an extrusion in one piece.

The chute system is used to guide a polymeric strap S as the strap S is fed around the load, tensioned, joined into a tensioned loop by applying a metal seal (not shown) or by welding, and severed by the strapping head. Means for providing such feeding, tensioning, joining, and severing actions are employed conventionally in a strapping machine of the type noted above. Except for the chute system 10, as illustrated and described, the strapping machine may be similar to Models SP-300 and SP-330 and other models of strapping machines sold heretofore under the SIGNODE trademark by Illinois Tool Works Inc. of Glenview, Ill., and its predecessor, Signode Corporation.

As shown in FIGS. 3 and 4 and other views, the chute 14 has a generally U-shaped cross-section defining a bight 16 and two generally parallel flanges 18 defined by the layers 14*a*, 14*c*, with a space defined by the layer 14*b* between the flanges 18 to accommodate a strap S being fed along the chute 14. As mounted by the mechanisms 10 to the wall 12 and biased by the mechanisms 10, the chute 14 is movable between a closed position wherein the flanges 18 bear against the wall 12 and opened positions wherein the flanges 18 are moved away from the wall 12 so as to allow a strap S to be pulled from the chute 14 without twisting of the strap S by any significant amount. The chute 14 is shown in the closed position in FIG. 3 and in an opened position in FIG. 4. As explained below, the mechanisms 10 bias the chute 14 toward the closed position but permit the chute 14 to move away from the wall 12 so as to allow a strap S to be pulled from the chute 14, as mentioned above.

As shown in FIG. 1, the mechanisms 10 are spaced from one another along the wall 12. A representative mechanism 10 is illustrated in FIGS. 2, 3, 4, and 5 and described below. As used herein, "back", "front", "upper", "lower", and other directional terms refer to the representative mechanism 10 in an exemplary orientation, in which it is illustrated in FIGS. 2, 3, 4, and 5. Such terms are not intended to limit this invention to any particular orientation.

Broadly, as shown in FIGS. 2, 3, 4, and 5, each mechanism 10 comprises a first bracket 20 mounted fixedly to the wall 12, a second bracket 22 supporting the chute 14 so as to be conjointly movable with the chute 14, a pivot arm 24 connected pivotally to the brackets 20, 22, and a coiled spring 26 biasing the pivot arm 24. The brackets 20, 22, are molded from a suitable, polymeric material, such as nylon filled with about 33% (by weight) glass fiber and about 15% (by weight) polytetrafluoroethylene. The pivot arm 24 is stamped from a steel sheet of a suitable thickness, e.g., 1.5 mm, so as to be generally C-shaped (see FIGS. 3, 4, and 5) and so as to have a first end portion 28 with a hole 30, a second end portion 32 with a hole 34, and an intermediate portion 36 with a slot 38 at a front edge 40. The coiled spring 26 is made from spring steel wire so as to have a hooked end 42 and a looped end 44.

The first bracket 20 has a back portion 52 with two parallel slots 54 receiving screw fasteners 56, which mount the first bracket 20 fixedly to the wall 12. The parallel slots 54 and the screw fasteners 56 enable the first bracket 20 to be adjustably positioned, over a limited range of adjusted positions, when mounted to the wall 12.

The first bracket 20 has an upper projection 60 projecting from the back portion 52 and having a front slot 62 of a suitable width, e.g. 1.8 mm, to accommodate the first end portion 28 of the pivot arm 24. The projection 60 has a bore 64, which extends through the projection 60, on both sides of the slot 62, and which accommodates a pivot pin 66 with a snug fit. The pin 66 spans the slot 62 and extends through the hole 30 so as to connect the first end portion 28 pivotally to the first bracket 20.

Below the upper projection 60, the first bracket 20 has a lower slot 72 of a suitable width, e.g., 2.4 mm, to accommodate the looped end 44 of the coiled spring 26. The first bracket 20 has a bore 74, which extends on both sides of the slot 72, and which accommodates a pivot pin 76 with a snug fit. The pin 76 spans the slot 72 and passes through the looped end 44 so as to connect the looped end 44 pivotally to the first bracket 20.

The second bracket 22 is generally C-shaped in side elevation (see FIGS. 3, 4, and 5) so as to have a lower portion 80, an upper portion 82, and an intermediate portion 84 and so as to define a recess 86 accommodating the chute 14, which is supported on a flat surface 88 of the lower portion 80, against the intermediate portion 84. The chute 14 is supported with the polymeric layer 14*c* engaging the flat surface 88. Although the polymeric materials used for the polymeric layer 14*c* and for the second bracket 22 and the arched configuration of the chute 14 should provide enough static friction to cause the chute 14 and the second bracket 22 to be conjointly movable and to eliminate any need to secure the chute 14 to the second bracket 22, the chute 14 may be optionally secured to the second bracket 22 via fasteners (not shown) or adhesively.

The upper and intermediate portions 82, 84, of the second bracket 22 have an upper slot 92 of a sufficient width, e.g., 12 mm, to accommodate the coiled spring 26 between the spring ends 42, 44. The intermediate and lower portions 84, 80, of the second bracket 22 have a front slot 94 of a suitable width, e.g., 2 mm, to accommodate the pivot arm 24. The lower portion 80 has a bore 96, which extends on both sides of the slot 94, and which accommodates a pivot pin 98 with a snug fit. The pin 98 spans the slot 92 and passes through the hole 34 in the second end portion 32 of the pivot arm 24 so as to connect the second end portion 32 pivotally to the second bracket 22.

As connected pivotally to the first bracket 20 at the looped end 30, the spring 26 extends along the slot 92, between the first and second brackets 20, 22. The hooked end 42 of the spring 26 is hooked into the slot 38 at the front edge 40 of the intermediate portion 36 of the pivot arm 24 so as to connect the hooked end 42 pivotally to the pivot arm 24, at the intermediate portion 36. Thus, the spring 26 biases the pivot arm 24 so as to bias the chute 14 toward the wall 12 but so as to permit the chute 14 to move away from the wall 12, thereby to allow a strap S to be pulled from the chute 14.

The mechanism 10, as described above, operates with very low friction, exhibits nearly linear motion of the chute 14 toward and away from the wall 12, and is not prone to binding due to accumulation of dust or other debris.

Various modifications may be made in the preferred embodiment described above without departing from the scope and spirit of this invention.

I claim:

1. In a chute system for a strapping machine, the chute system comprising a fixed wall and a movable chute, the chute having a generally U-shaped cross-section defining a bight and two generally parallel flanges with a space between the flanges to accommodate a strap being fed along the chute, the chute being movable toward and away from a closed position wherein the flanges bear against the wall, a mechanism for mounting the chute to the wall and for biasing the chute toward the wall while permitting the chute to move away from the wall so as to allow a strap to be pulled from the chute, the mechanism comprising a first bracket mounted fixedly to the wall, a second bracket movable conjointly with the chute, and a pivot arm having a first end portion connected pivotally to the first bracket, a second end portion connected pivotally to the second bracket, and an intermediate portion between the first and second ends the mechanism further comprising means for biasing the pivot arm so as to bias the chute toward the wall but so as to permit the chute to move away from the wall.

2. The mechanism of claim 1 wherein the biasing means comprises a coiled spring connected to the intermediate portion of the pivot arm.

3. The mechanism of claim 2 wherein the coiled spring has first and second ends, the first end connected to the intermediate portion of the pivot arm and the second end connected to the first bracket.

4. The mechanism of claim 3 wherein the coiled spring extends from the first end connected to the intermediate portion of the pivot pin between the first and second brackets, to the second end connected to the first bracket.

* * * * *